United States Patent [19]

Oishi et al.

[11] Patent Number: 4,909,180

[45] Date of Patent: Mar. 20, 1990

[54] ASSEMBLY OF ELECTROSTATIC ROTARY SPRAYERS

[75] Inventors: Shogo Oishi, Toyota; Iwao Nomura, Kasugai; Kouji Ohta, Toyota; Naoki Yamada, Toyota; Hitoshi Takeuchi, Toyota, all of Japan

[73] Assignee: Toyota Jidosha Kabushiki Kaisha, Aichi, Japan

[21] Appl. No.: 136,935

[22] Filed: Dec. 23, 1987

[30] Foreign Application Priority Data

Dec. 27, 1986 [JP] Japan ..... 61-309262

[51] Int. Cl.[4] ..... B05B 5/00

[52] U.S. Cl. ..... 118/626; 118/315; 118/323; 118/326; 118/302; 239/695

[58] Field of Search ..... 118/626, 627, 628, 629, 118/630, 631, 632, 633, 634, 698, 302, 315, 326, 323; 901/43; 239/695, 696, DIG. 14

[56] References Cited

U.S. PATENT DOCUMENTS

| | | | |
|---|---|---|---|
| 2,421,787 | 6/1947 | Helmuth | 118/630 X |
| 2,598,466 | 5/1952 | Tuttle et al. | 118/633 X |
| 2,764,712 | 9/1956 | Juvinall | 118/626 |
| 2,996,042 | 8/1961 | Juvinall | 118/630 X |
| 3,019,136 | 1/1962 | Auffewdrde et al. | 118/314 X |
| 3,402,697 | 9/1968 | Kock | 118/631 X |
| 3,446,183 | 5/1969 | Drum | 118/629 |
| 3,691,991 | 9/1972 | Luderer et al. | 118/629 |
| 4,232,255 | 11/1980 | Shaffer | 118/624 X |
| 4,341,821 | 7/1982 | Toda et al. | 427/426 X |
| 4,350,304 | 9/1982 | Sugiyama et al. | 239/703 |
| 4,403,736 | 9/1983 | Scharfenberger | 118/302 X |
| 4,676,189 | 6/1987 | Takeuchi et al. | 118/626 |
| 4,762,013 | 8/1988 | Peter | 118/315 X |

FOREIGN PATENT DOCUMENTS

| | | |
|---|---|---|
| 0016823 | 4/1984 | Japan . |
| 0204265 | 4/1984 | Japan . |

OTHER PUBLICATIONS

PTO, English translation of Japanese (Kokai) Pat. No. 59-16823, 3-88.

English Translation of 57-204265; PTO, 3-9-88.

*Primary Examiner*—Shrive Beck

*Assistant Examiner*—Alain Bashore

*Attorney, Agent, or Firm*—Finnegan, Henderson, Farabow, Garrett and Dunner

[57] ABSTRACT

A rotary type electrostatic spray coating device comprising two or more side spray coating units having two or more spray heads separated from each other at a distance larger than a width of the coating pattern of each spray head, and the same negative high voltage is simultaneously applied to all of the spray heads during a spray coating operation; thus enabling a shortening of the length of the spray coating booth, improving a flatness of the paint coating on the work pieces, and completely preventing an undesirable deposition of paint mist on the spray heads.

4 Claims, 4 Drawing Sheets

ASSEMBLY OF ELECTROSTATIC ROTARY SPRAYERS

BACKGROUND OF THE INVENTION

1. Field of the Invention

The present invention relates to a rotary type electrostatic spray coating device. More particularly, the present invention relates to an improvement of side spray coating unit used in such a spray coating device. The spray coating device according to the present invention can be effectively used for spray coating automotive bodies and other work pieces with different paints.

2. Description of the Related Art

As is well-known in the art, a variety of electrostatic spray coating processes and devices have been widely used in the spray coating of different size work pieces. In particular, a rotary type electrostatic spray coating process and device has been used due to the excellent coating efficiency and other effects thereof. Generally, the prior art rotary type electrostatic spray coating device, as described in, for example, Japanese Unexamined Patent Publication (Kokai) No. 56-115652, has a structure wherein a rotary shaft with a fixed spray head such as a bell cup or mini-bell cup is rotatably supported in a metallic air motor housing, the rotary shaft is rotated at a high speed by an air motor, while a negative voltage is continuously applied thereto from a high voltage generator, a paint is fed onto a cup-shaped inner wall of the spray head, and thus a negatively charged paint mist is emitted from the spray head and sprayed onto a surface of the work piece to be spray coated, such as the body of a motor car. A similar rotary type electrostatic spray coating device is described in U.S. Pat. No. 4,350,304 issued Sept. 21, 1982.

In addition, many improved rotary type electrostatic spray coating devices have been disclosed in Japanese and U.S. patents and applications. For example, Japanese Unexamined Patent Publication (Kokai) No. 56-139164 discloses an improvement of a reciprocating machine in the spray coating device. To ensure an uniform thickness of the resulting paint coating, Kokai '164 teaches to incline a spray coating equipment movable on the reciprocating machine so that a spray head thereof faces only a work piece to be coated. Japanese Unexamined Patent Publication (Kokai) No. 57-165064 discloses an improvement of the spray coating of an outer plate of an automotive body. Kokai '064 teaches to adjust a direction of the spray head in accordance with the portion of the outer plate to be coated, thus obtaining a uniform thickness of the resulting coating.

The above two Japanese Publications concern an improvement of the uniformity of the paint coating. Japanese Unexamined Patent Publication (Kokai) No. 57-194072 discloses that, if a discharge of the charged paint is temporarily stopped and a differential potential of the work piece to be coated with regard to the charged paint is reduced when the spray coating equipment reaches a location where coating is not required, an error in operation of the high voltage shut-off device therein can be prevented. Japanese Unexamined Patent Publication (Kokai) No. 57-204265 teaches that, to prevent coating defects such as electrostatic craters and the so-called "flowering phenomenon" due to electrostatic charges, a dark electric current passed through a spray coating device to a work piece should be adjusted to a value lower than a predetermined value. Japanese Unexamined Patent Publication (Kokai) No. 58-174269 teaches to provide a high-speed and low-speed flow of air in a spray booth to increase a paint coating efficiency on a work, to prevent flying and adhesion of the spray dust, and reduce the amounts of air introduced into and discharged from the spray booth. Japanese Unexamined Utility Model Publication (Kokai) No. 61-139775 teaches to install spray guns on the side walls of the spray booth and to form air curtains along said side walls to prevent flying and deposition of not-used paint mists on said side walls and guns.

There are many U.S. patents disclosing improved electrostatic spray coating devices. U.S. Pat. No. 3,691,991 discloses a spray coating apparatus which includes a removable and replaceable supply container for the coating material. The apparatus of this U.S. patent has many advantages, such as a simplification of the adjustment of the apparatus, switching over of the high voltage supply at a control desk, and quick cleaning of the injector and a quick change-over from one color to another color. U.S. Pat. No. 4,232,055 concerns an improved electrostatic spraying system capable of automatically painting work pieces with different colored electrically conductive paints. According to this system, it is possible to selectively spray a plurality of paints with different colors. U.S. Pat. No. 4,676,189 of the present inventors, issued later than the filing date of Japanese patent application No. 61-309262 (basis of the instant application), concerns an attachment construction of a hosepipe of an electrostatic spray coating apparatus. The functioning of the apparatus can be tested before installation at a work location.

Referring again to Japanese Kokai No. 57-204265, FIG. 1 thereof (reproduced herein also as FIG. 1) illustrates a typical rotary-type electrostatic spray coating device for automotive bodies. In the illustrated spray coating line, automotive bodies 1 each having door portions 2 and protruding portions 3 are continuously conveyed in the direction indicated by an arrow A. Both side portions of the automotive body 1 are spray coated, during this passage through the line, in sequence by a pair of low-positioned side spray heads 4 and by a pair of high-positioned side spray heads 5. The body 1 is then guided under a pair of top spray heads 6 installed on a gate-type reciprocator 7, and thus the top portion of the body 1 is spray coated. Although FIG. 1 shows only two pairs of side spray heads, conventionally three pairs of the side spray heads are disposed in the spray coating line to attain a satisfactory paint coating efficiency. In addition, recently, as illustrated in FIG. 2, four pairs of side spray heads are frequently disposed in the spray coating line to further increase the paints coating efficiency and to widen the coating area. The spray coating booth shown in FIG. 2 has two pairs of low-positioned side spray heads 4 and 14, two pairs of high-positioned side spray heads 5 and 15, and a pair of top spray heads 6.

There is a tendency to increase the number of side spray coating units in the spray booth, as can be appreciated from the above descriptions concerning the prior art spray coating devices, to increase a paint coating efficiency thereof. However, this increase in the number of side spray coating units, particularly the side spray heads, causes a problem in that the paint mist from the side spray heads adheres to other side spray heads during the spraying operation. This problem arises due to the switching on and off of the high voltage generators for the side spray heads, and will be now described with reference to FIG. 2, in which four pairs of side array heads are disposed along a line conveying automotive bodies. For example, when all of the side spray heads 4, 14, 5 and 15 are simultaneously used for spray coating, only a negligible amount of the paint mist is deposited on each spray head, since all spray heads are maintained under the same high potential during spray coating. However, if one of said spray heads, for example, spray heads 14, are not operated and are washed with a thinner for color changing, a large amount of the paint mist from the remaining spray heads 4, 5, and 15 being operated will adhere to the spray heads 14, because a difference in potential is generated between the heads 14 and heads 4, 5, and 15 as a result of a removal of the high voltage from the heads 14 during the color change washing. To avoid this adhesion of the paint mist, generally two adjacent side spray heads are disposed at a large distance or bell pitch of about 1.5 to 1.8 mm. The increase of the distance between the subsequent spray heads also causes an increase of the length of the spray booth and a rise in the initial costs and running costs because of a corresponding extension of the air conditioning space.

In addition, another problem arises of overlapping of the coating patterns of the paint from two adjacent spray heads, such as two successive side spray heads and two adjacent side and top spray heads. When there is a large distance or bell pitch between these two spray heads or the conveyor of automotive bodies is driven at a low speed, i.e., when there is a large time lag from the end of the spray coating to the start of the next spray coating, a good flatness of the coating surface can not be obtained on the spray coated automotive bodies due to a complete drying of the particles of the previously coated paints.

SUMMARY OF THE INVENTION

It is an object of the present invention to provide an improved rotary type electrostatic spray coating device, which will prevent the adhesion of a paint mist on the spray heads, without an increase of the distance or bell pitch between subsequent spray heads, and increase a flatness of the surface of the coated work pieces.

According to the present invention, there is provided a rotary type electrostatic spray coating device in which two or more side spray coating units are disposed along a line conveying work pieces to be spray coated, said side spray coating units each having two or more vertically installed spray heads which are separated from each other by a distance larger than a width of the coating pattern of each spray head. The same negative high voltage is applied to all of the spray heads during spray coating, from one or more high voltage generators through corresponding air motors, and the spray heads are each connected to a color changing unit.

In the electrostatic spray coating device of the present invention, when the number of side spray coating units to be installed is increased, an extension of the installation area or an increase of the length of the spray booth can be avoided, since two or more spray heads can be vertically installed on the one side of the spray coating booth. Further, since these spray heads installed on the same side of the booth can be always maintained at the same potential, adhesion of a paint mist from the upper spray heads on the lower spray heads can be completely prevented, because the paint particles sprayed from the upper spray heads and the spray heads positioned below the upper spray heads electrically repel each other. Furthermore, since the upper and lower spray heads are simultaneously operated, there is no time lag in the spray coating process using these heads and, therefore, a poor flatness of the coated surface due to a differential in the drying of the paint particles can be also prevented.

DESCRIPTION OF THE PREFERRED EMBODIMENTS

Figure 1:
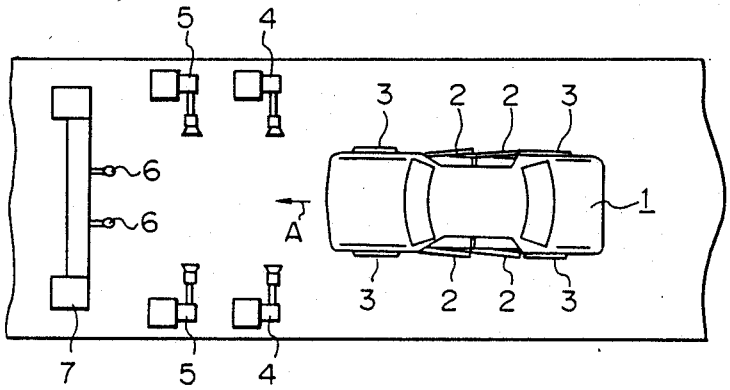
Fig. 1 PRIOR ART
FIG. 1 is a plan view of the spray coating booth according to a prior art electrostatic spray coating process.
Figure 2:
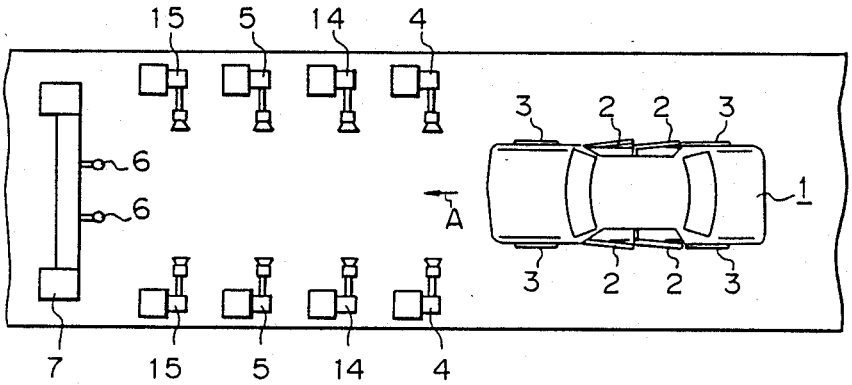
Fig. 2 PRIOR ART
FIG. 2 is a plan view of the spray coating booth according to another prior art electrostatic spray coating process.

In a preferred embodiment of the present invention, two or more pairs of the side spray coating units are disposed across the line conveying the work pieces to be spray coated, for example, automobiles bodies. Further, the side spray coating unit used is preferably provided with a single high voltage generator from which the same negative high voltage is simultaneously applied to all spray heads thereof through the corresponding air motors.

In another preferred embodiments, the side spray coating unit used in the spray coating device of the present invention has two upper and lower spray heads. These spray heads may have any conventional forms, such as a bell., mini-bell, and disc. Preferably, the side spray coating unit comprises a reciprocating device having installed thereon two upper and lower insulating supports, each of the supports having an air motor and a spray head rotatably supported by the air motor, air motors connected through a high-voltage cable with a common high voltage generator, and the spray head is connected through a paint hose with a color changing unit.

The color changing unit used in the present invention preferably comprises a manifold having an outlet connected with one end of the paint hose and having two or more color-changing valves each connected to a source of different color paint, a washing thinner valve connected to a thinner source, and a washing air valve connected to an air source.

In still another embodiment, the spray head used in the practice of the present invention has a washing shroud which is pushed forward during the washing operation in the color changing process to surround the spray head, and is retracted during the coating operation.

The spray coating device of the present invention preferably further comprises, in addition to the side spray coating units, one or more top spray coating units having two or more top spray heads disposed over the line conveying the work pieces.

The spray coating device according to the present invention can be effectively and widely used in the process of spray coating a variety of large or small work pieces having a simple or a complex structure. Most preferably, the coating device of the present invention can be used for spray coating automotive bodies with two or more paints of a different color.

A preferred embodiment of the present invention will be described hereinafter with reference to FIG. 3, which illustrates a side view of the side spray coating unit used in the spray coating device of the present invention. In the side spray coating unit 10 illustrated in the FIGURE, a reciprocating device 20 has an upper insulating support 8 and lower insulating support 18 fixed thereto, and an air motor 9 capable of rotatably supporting a spray head 11 and an air motor 19 capable of rotatably supporting a spray head 21 are fixed to those supports 8 and 18, respectively. The spray heads 11 and 21 used herein are bell-type. A high voltage generator 16 is connected via a high-voltage cable 12 to a triple connector 29, and one outlet of the triple connector is then connected through a high-voltage cable 28 to the air motor 9, and another outlet of the connector is connected through a high-voltage cable 38 to the air motor 19. A color changing unit for the spray head 11 comprises a manifold 13 provided with color-changing valves 24 and 25, each connected to a paint source supplying a different color paint (not shown), a washing thinner valve 26 connected with a thinner source (not shown), and a washing air valve 27 connected with a pressurized air source (not shown). An outlet of the manifold 13 is connected via a paint hose 12 to the spray head 11. Similarly, a color changing unit for the spray head 21 comprises a manifold 23 having color-changing valves 34 and 35, a thinner valve 36, and an air valve 37 fixed thereto, and an outlet of the manifold 23 is connected via a paint hose 22 to the spring head 21.

Figure 3:
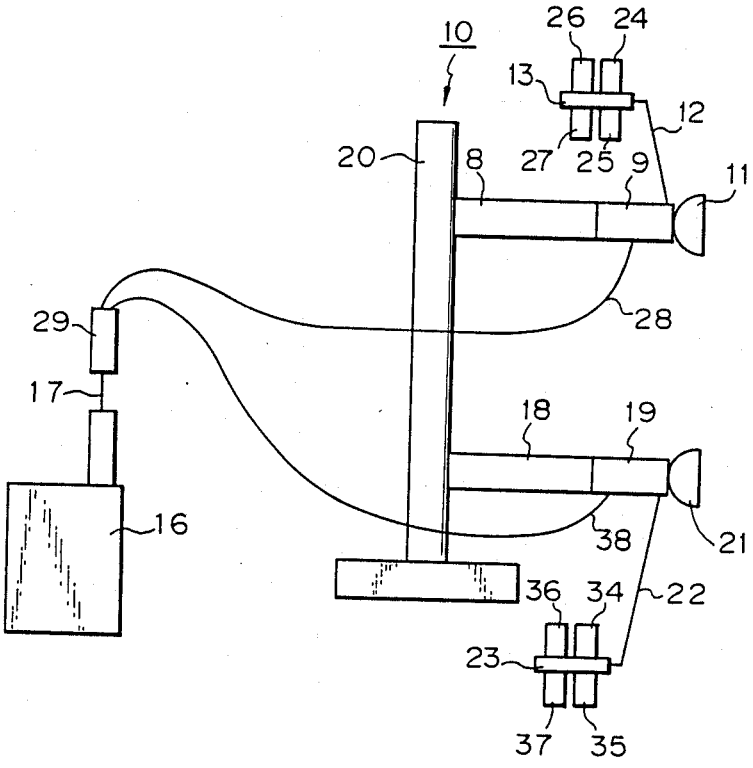
FIG. 3 is a side view of the side spray coating unit used in the electrostatic spray coating device according to the present invention.

The side spray coating unit of FIG. 3 is operated as follows:

When one of the work pieces (not shown) to be spray coated, which are continuously conveyed along the spray coating line, reaches a predetermined position, a start signal is output to start the rotation of the air motors 9 and 19, and thus of the spray heads 11 and 21, respectively. The spray heads 11 and 21 rotate at a predetermined number of revolutions.

As apparent from the above description, the spray head 11 and related devices are simultaneously operated with the spray head 21 and related devices. Accordingly, hereinafter, the operation of the spray coating unit will be described with reference to the spray head 11 and related devices. When the spray head 11 rotates at a predetermined number of revolutions, the color-changing valve 24 for a first color paint is previously opened for a predetermined short time to fill a full length of the paint hose 12 with the first color paint. After the hose 12 is filled with the paint, the high voltage generator 16 is switched ON, and a negative high voltage is applied through the high-voltage cable 17, triple connector 29, and high-voltage cable 28, in sequence, to the air motor 9.

When the negative high voltage is applied to the air motor 9, a coating-starting signal is transmitted to open the color-changing valve 24, and the first color paint is fed from the paint source (not shown) to the spray head 11, and since the spray head 11 is rotating, spray coating of the work piece with the first color paint is immediately started. This spray coating is continued until the work piece reaches a predetermined position in the spray coating line.

After the spray coating of the first color paint is completed, the color-changing valve 24 is closed by a coating-ending signal and the operation of the high voltage generator 16 is also stopped.

Thereafter, the manifold 13, paint hose 12 and spray head 11 are washed to remove the first color paint remaining therein.

This washing, i.e., color-changing washing, is started by a color-changing signal sent to a color changing unit. Upon receipt of the color-changing signal, the thinner valve 26 and the pressurized air valve 27 in the color changing unit are opened alternately, and the remaining first paint is thus completely removed from the manifold 13, hose 12, and spray head 11.

In the same manner as described above with reference to the color-changing valve 24 for the first color paint, the work piece can be also spray-coated by using a color-changing valve 25 for a second color paint. Therefore, the spray coating of the work piece with the second color paint will not be described herein. The other side spray coating units used in the spray coating device of the present invention can be also operated in the manner described above.

Figure 3A:
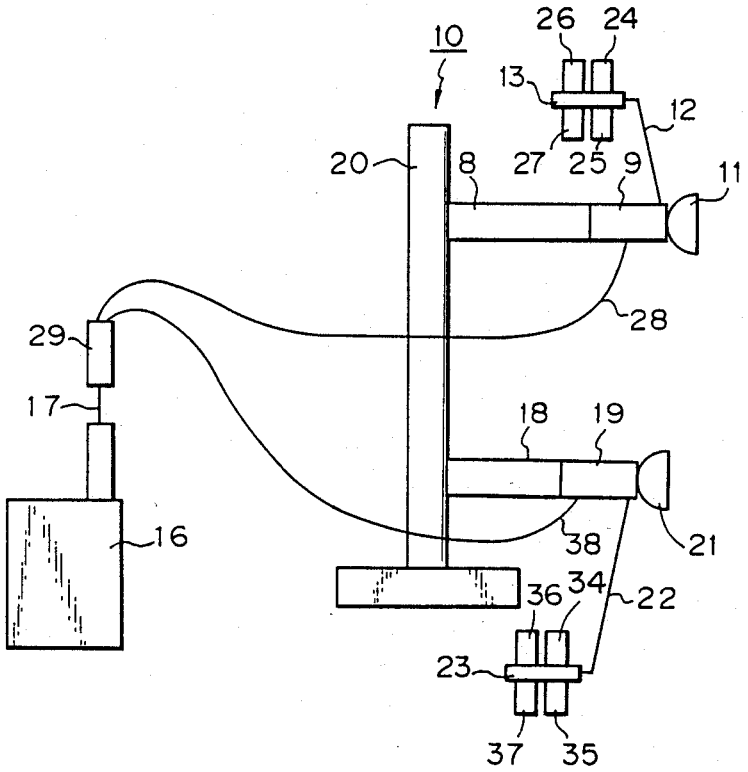
FIG. 3A is a side view of the side spray coating unit of FIG. 3 illustrating the upper spray head laterally spaced closer to the center line of the booth than the lower spray head.

When the side spray coating unit of FIG. 3 is used, it has been found that, if the spray heads 11 and 21 are used at a coating pattern width of about 600 mm and a distance from tfie head to the work piece to be coated of about 300 mm, good quality coatings are obtained and the deposition of the paint mist from the upper spray head 11 on the lower spray head 21 is prevented, if the bell pitch between the spray heads 11 and 21 is 700 mm or more. In practice, no undesirable interference of the coating patterns, i.e., disturbance in the distribution of the coating pattern due to concurrent spray coating by using the upper and lower spray heads 11, could be observed in the coated work piece. Further, as illustrated in FIG. 3A, it has been found that, if the upper spray head 11 is installed in a position nearer to the center line of the spray booth than the lower spray head 11, the adhesion of the paint mist to the spray head can be more effectively prevented. From these results, it is clear that, if the spray coating device of the present invention is used in the spray coating of automotive bodies, undesired deposition of the paint mist on the spray heads, which could not be avoided in the prior art spray coating process, can be prevented or remarkably diminished by installing a spray head for coating pillar portions and a spray head for locker portions on a single common reciprocating machine of the side spray coating unit.

Figure 4:
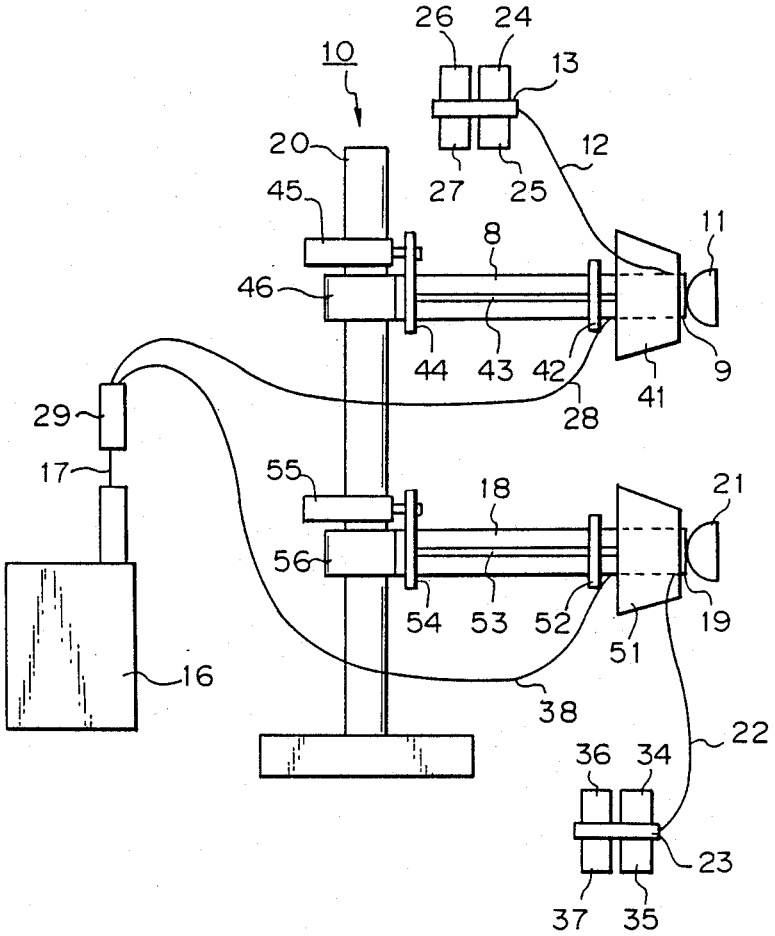
FIG. 4 is a modification of the side spray coating unit of FIG. 3.

FIG. 4 shows a modification of the side spray coating unit of FIG. 3. This equipment is substantially the same as that of FIG. 3 except that washing shrouds 41 and 51 with the driving means are added to further improve the efficiency of washing the spray heads 11 and 21, respectively. The shrouds 41 and 51 are reciprocated depending upon the specific operation in the color changing process. Namely, the shrouds 41 and 51 are moved forward and held at that position during the washing operation, and are retracted before the start of the next coating operation. To ensure this reciprocating movement, the shroud 41 is provided with the following driving means: The shroud 41 is connected with one end of a guide axis 43, and this guide axis 43 for the shroud 41 is supported by two brackets 42 and 44. The bracket 44 supporting an end portion of the guide axis 43 is fixed to a rod side of a shroud driving cylinder 45 installed on a holder 46, together with an insulating support 8. Further, the bracket 42 is installed at an interface between the insulating support 8 and an air motor 9. The driving mechanism of the shroud 41 will be understood from FIG. 4 and the above description of the driving means. In addition, since the other washing shroud 51 is reciprocally movable by the same driving mechanism as used for the shroud 41, a detailed description of the working of the shroud 51 will be omitted herein. In FIGS. 3 and 4, it should be also noted that, in FIG. 4 the same reference numerals are given to the same parts or means as shown in FIG. 3.

As apparent from the above descriptions of the preferred embodiments, according to the present invention, a distance between two subsequent side spray coating units in the prior art coating device of about 3.0 to 3.6 m can be reduced by a half, i.e., to about 1.8 m or less. This reduction of the length or pitch between two coating units shortens the length of the spray coating booth, thereby enabling a large reduction of the initial costs and running costs of the coating booth and accompanying air conditioning. Further, two or more spray heads on the side spray coating unit can be simultaneously operated and, therefore, a flatness of the coating in the overlapped portion of the coating patterns of the two spray heads can be notably improved. Furthermore, upper and lower spray heads can be always maintained at the same potential, thereby inducing the effect that the paint particles from the spray heads repel each other. This repellent action caused by the potentials of the spray heads in the same coating unit effectively and completely removes the problem of the deposition of the paint mist on the spray heads.

We claim:

1. An assembly for the electrostatic spray coating of large-sized workpieces being conveyed along a path in a spray booth having a center line, comprising:

at least one rotary type electrostatic spray coating unit for spraying a side of the workpiece, at least two spray heads mounted to each said at least one unit along a vertically extending axis with each spray head having a respective air motor for spraying a coating pattern of a predetermined width;

each said at least one unit with the spray heads thereof being spaced laterally from the center line with an upper spray head being spaced above a lower spray head along the vertically extending axis a distance greater than the predetermined width of the spray coating of each spray head, and said upper spray head being spaced closer to the center line of the spray booth than said lower spray head for minimizing adhesion to the lower spray head of spray mist from the upper spray head;

a color changing unit for the at least one spray coating unit;

a paint hose operatively connecting the at least two spray heads to the color changing unit for changing the color of the coating to be sprayed;

a high voltage generator commonly connected electrically to all spray heads of the at least one spray coating unit through the air motors for negatively charging the heads of the unit simultaneously with the same polarity.

2. The assembly of claim 1, further comprising a flexible cable connecting the high voltage generator to the air motors, and wherein the at least one spray coating unit includes a reciprocating device having two upper and lower insulating support members mounted thereon, each of said support members supporting an air motor and a spray head, said spray head being rotatably supported by the air motor.

3. The assembly of claim 2, wherein said at least one spray coating unit includes a washing shroud mounted adjacent each of the at least two spray heads and movable laterally for surrounding said spray heads during a washing of a respective head with a thinner prior to spray coating with a different color.

4. The assembly of claim 2, wherein said color changing unit includes a manifold having an outlet connected to one end of said paint hose and at least two color-changing valves for controlling the supply of different color paints, a washing thinner valve for controlling the supply of thinner, and a washing air valve.

* * * * *